US010526870B2

(12) United States Patent
Van Petegem et al.

(10) Patent No.: US 10,526,870 B2
(45) Date of Patent: Jan. 7, 2020

(54) DOWNHOLE ACTUATION BALL, METHODS AND APPARATUS

(71) Applicant: PACKERS PLUS ENERGY SERVICES INC., Calgary (CA)

(72) Inventors: Ronald Van Petegem, Montgomery, TX (US); John Lee Emerson, Katy, TX (US)

( * ) Notice: Subject to any disclaimer, the term of this patent is extended or adjusted under 35 U.S.C. 154(b) by 82 days.

(21) Appl. No.: 15/199,347

(22) Filed: Jun. 30, 2016

(65) Prior Publication Data

US 2017/0002628 A1 Jan. 5, 2017

Related U.S. Application Data

(60) Provisional application No. 62/186,959, filed on Jun. 30, 2015.

(51) Int. Cl.

| | |
|---|---|
| ***E21B 29/02*** | (2006.01) |
| ***E21B 34/06*** | (2006.01) |
| ***E21B 34/14*** | (2006.01) |
| *E21B 34/00* | (2006.01) |

(52) U.S. Cl.
CPC ..... *E21B 34/14* (2013.01); *E21B 2034/007* (2013.01)

(58) Field of Classification Search
CPC ..... E21B 34/12; E21B 34/14; E21B 29/00; E21B 2034/007; E21B 33/16
See application file for complete search history.

(56) References Cited

U.S. PATENT DOCUMENTS

| | | | | |
|---|---|---|---|---|
| 2,493,650 | A | 1/1950 | Baker et al. | |
| 2,633,916 | A | 4/1953 | Baker et al. | |
| 2,651,368 | A * | 9/1953 | Baker | E21B 34/14 137/70 |
| 3,842,905 | A * | 10/1974 | Morrisett | E21B 33/1204 166/155 |
| 6,923,255 | B2 | 8/2005 | Lee | |
| 8,231,947 | B2 | 7/2012 | Vaidya et al. | |
| 8,403,037 | B2 | 3/2013 | Kgrawal et al. | |
| 8,413,727 | B2 | 4/2013 | Holmes | |
| 8,905,146 | B2 | 12/2014 | Gaudette et al. | |
| 8,905,147 | B2 | 12/2014 | Fripp et al. | |
| 2012/0160478 | A1 | 6/2012 | Todd et al. | |
| 2012/0273229 | A1 | 11/2012 | Xu et al. | |
| 2013/0032357 | A1 | 2/2013 | Mazyar et al. | |
| 2013/0206425 | A1 | 8/2013 | Mazyar et al. | |
| 2014/0202713 | A1* | 7/2014 | Stewart | E21B 34/14 166/386 |
| 2014/0332233 | A1 | 11/2014 | Walton et al. | |
| 2016/0108722 | A1* | 4/2016 | Whitsitt | E21B 34/14 166/254.1 |

FOREIGN PATENT DOCUMENTS

| | | | | |
|---|---|---|---|---|
| WO | 2008146012 | | 12/2008 | |
| WO | 2013053055 | | 4/2013 | |
| WO | 2013053057 | * | 4/2013 | E21B 23/10 |

* cited by examiner

*Primary Examiner* — David J Bagnell
*Assistant Examiner* — Dany E Akakpo

(57) ABSTRACT

An actuation ball for a downhole tool, the actuation ball includes an outer annular body encircling a bore; and a core releasably installed in the bore, such that the core can be removed to permit back flow through the bore.

22 Claims, 3 Drawing Sheets

DOWNHOLE ACTUATION BALL, METHODS AND APPARATUS

BENEFIT OF EARLIER APPLICATION

This application claims priority to U.S. provisional application Ser. No. 62/186,959, filed Jun. 30, 2015.

FIELD

The present invention relates to downhole tools and, in particular, a downhole actuation ball for driving downhole tools. Apparatus and methods employing the actuation ball are also described.

BACKGROUND

Actuation balls are used to drive downhole tools. For example, actuation balls may be launched to drive a hydraulic sleeve. Hydraulic sleeves are used in various tools and include an annular seat on the sleeve that is formed to accept and catch a suitably sized ball thereon. When a ball lands thereon, a seal is formed between the ball and the sleeve that inhibits fluid flow therepast such that a hydraulic pressure can be built up above the ball, such hydraulic pressure being suitable to move the sleeve along the tubular in which it is installed. One possible sleeve and ball system is described in U.S. Pat. No. 6,907,936 of Jun. 21, 2005 to the assignee of the present application. While actuation ball is the general term, some such balls do not have a typical spherical "ball-like" structure and it should be understood that the structure may be closer in shape to a dart or plug.

SUMMARY

In accordance with a broad aspect of the present invention, there is provided an actuation ball for a downhole tool, the actuation ball comprising: a core; an outer body through which fluid can flow if the core is removed; and a mechanical connection between the core and the outer body, the mechanical connection configured to permit separation of the core from the outer body.

In accordance with another broad aspect of the present invention, there is provided a method for operating a downhole tool, the downhole tool including a tubular body; a sliding sleeve valve positioned within and axially moveable along a length of the tubular body, the sliding sleeve valve including a valve seat; and an inner bore defined by an inner wall of the tubular body and of the sliding sleeve valve, the method comprising: moving an actuation ball from above the downhole tool such that the actuation ball moves through the inner bore and the actuation ball lands in a valve seat of the sliding sleeve valve; applying pressure from above the actuation ball to drive the sliding sleeve valve to operate the downhole tool; and opening the actuation ball to permit back flow by expelling a core of the actuation ball from a bore of a body portion of the actuation ball by the pressure of backflowing fluids.

In accordance with another broad aspect of the present invention, there is provided an actuation ball for a downhole tool, the actuation ball comprising: an outer body including an upper end, a lower end and a bore extending from the upper end to the lower end; and a core in the bore sealing against fluid flow through the bore, wherein the core is formed of a first degradable material and the outer body is made of a second material that degrades slower than the first degradable material such that the core disintegrates faster than the outer body.

It is to be understood that other aspects of the present invention will become readily apparent to those skilled in the art from the following detailed description, wherein various embodiments of the invention are shown and described by way of illustration. As will be realized, the invention is capable of other and different embodiments and its several details are capable of modification in various other respects, all within the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

An actuation ball, also called a plug or a dart, is a component of a downhole tool assembly. The actuation ball may take many different forms, but is conveyed to actuate a downhole tool. Generally, the downhole tool has a seating surface against which the ball lands, solidly or temporarily, to create a seal in the tool so that it can be actuated, for example by hydraulic pressure.

Figure 1:
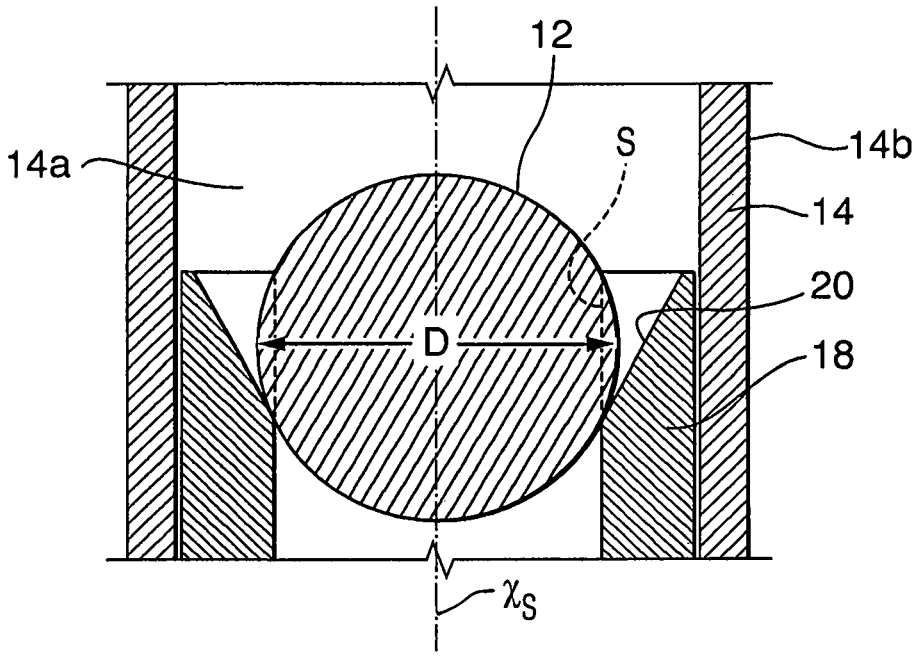
FIG. 1 (Prior Art)
FIG. 1 is a sectional view through a standard actuation ball landed in a valve seat.

A prior art downhole tool assembly is shown in FIG. 1. A downhole tool assembly includes a ball 12 and a tool including a tubular body 14 and a sliding sleeve valve 18 positioned within and axially moveable along a length of the tubular body. Sliding sleeve valve 18 includes a valve seat 20 sized to catch ball 12. Valve seat 20 can take various forms. For example, the valve seat may include (i) a ball stop protruding into the inner diameter of the tubular body that catches ball 12 but allows some flow therepast, (ii) a ball stop that catches the ball and holds it in a sealing position against an adjacent sealing annular area, (iii) a structure that is fixed or a structure that is eventually overcome to let the ball pass, or (iv) a combined ball stop and sealing surface. In the illustrated embodiment, sliding sleeve valve 18 includes a valve seat that is a combined ball stop and sealing surface. Valve seat 20 is formed on an inner facing wall 18*a* defining a bore through sleeve 18 from end to end and an upper portion of the inner facing wall has a tapering inner diameter to form valve seat 20 which is an inclined seating surface formed to catch and seal with actuation ball 12. The seat is often circular in orthogonal section from the sleeve's long axis $x_s$. Thus, the seat often has a generally frustoconical surface with an inner diameter tapering from its upper end to its lower end. Valve seat 20 and ball 12 are correspondingly sized (i.e. the diameter of the ball, D ball, corresponds with the inner diameter at the seat) such that the ball can land on and create a seal against the seat.

Tubular body 14 can be formed to be installable in downhole strings such as liners, casing, production strings, well treatment strings, etc. For example, the tubular body may have an upper end and a lower end formed with threads such as threaded pins and boxes for threaded engagement to adjacent tubulars.

The form of the tubular body can depend on the function of the tool. Tubular body 14, for example, may include ports through which fluid can pass between the inner bore 14*a* and outer surface 14*b* of the tubular body. The ports are opened and closed by movement of sleeve valve 18. Sleeve valve 18 can be moved by landing ball 12 in its seat 20. Sleeve valve 18 may be secured by releasable holding devices such as shear pins, lock rings, etc., which can be overcome if a certain force is applied thereto.

When ball 12 lands in its seat, a piston is created on sleeve valve 18 through the sealing of the ball against the seat and pressure can be built up above the piston to create a pressure differential across the piston, which drives the sleeve down to the lower pressure side.

Any holding devices such as pins are overcome when a suitable differential is reached. Ball 12 must therefore be durable and capable of withstanding at least the force to move the sleeve. Ball must withstand significant forces especially along shear plane S. Sometimes a standard ball may fail along a shear plane S.

After the ball does its work, for example, moves the sleeve, it is desirable for the bore through the sleeve to be reopened so that fluid flows and tools can pass therethrough. A standard ball 12 is intended to move off the sleeve, but extrusion of ball 12 through the sleeve, may jam the ball in the seat.

Figure 2:
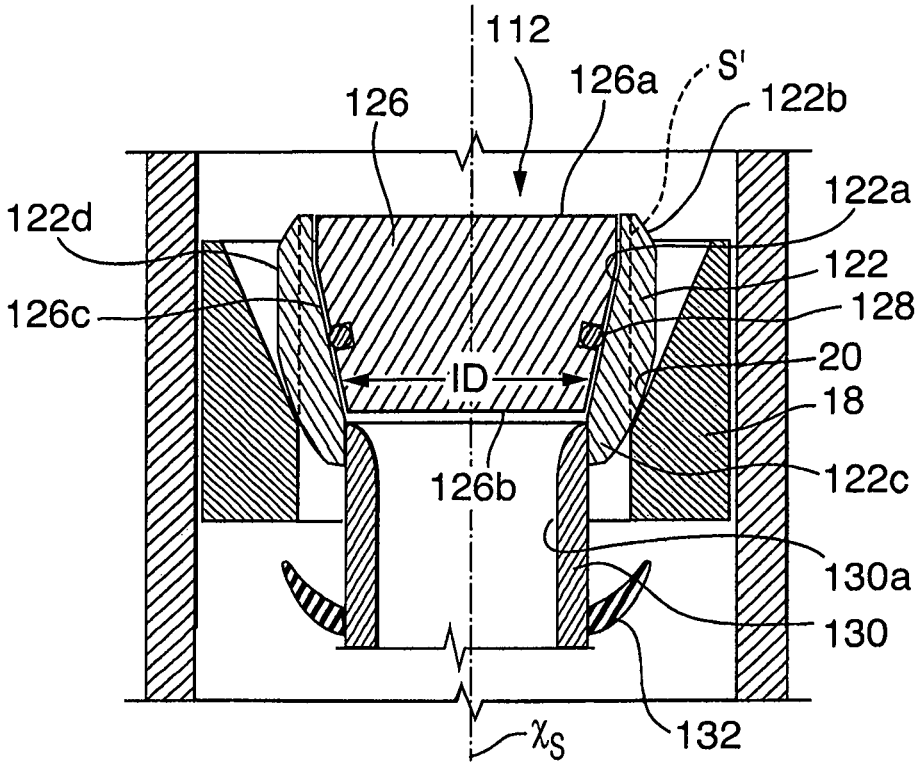
FIG. 2 is a sectional view along a center axis of an actuation ball according to one aspect of the invention landed in a valve seat.

With reference to FIG. 2, the present ball 112 is useful to operate a downhole tool with one or more options as described above. Ball 112 is shown landed on a valve seat 20 of a sliding sleeve valve 18.

Ball 112 includes an outer annular body 122 and a core 126.

Annular body 122 includes inner facing walls 122*a* defining therebetween a bore. The bore has an inner diameter ID that tapers from a trailing end 122*b* to a leading end 122*c*. Annular body 122 may be deformable.

Core 126 is releasably installed in the bore of annular body 122. The core has a piston face end 126*a*, a forward end 126*b* and frustoconical side walls 126*c* between the piston face end and the forward end. The frustoconical side walls define an outer diameter that tapers toward forward end 126*b*. The taper angle on frustoconical side walls 126*c* may be similar to the taper of inner diameter ID, such that the parts fit together in a wedge-lock type arrangement.

There is a seal between frustoconical side walls 126*c* and inner facing walls 122*a*. The fluid tight seal may be formed in various ways, as by a close fit, or an installed seal ring 128.

Ball 112 is configured such that the outer surface 122*d* of outer annular body 122 lands in valve seat 20 and pressure is applied across trailing end 122*b* and piston face end 126*a*. The tapering diameter of the bore and the corresponding frustoconical side walls 126*c*, and the possible freedom for core 126 to slide down slightly toward leading end, may create a wedging effect that actually expands/deforms the outer annular body 122 into greater bearing load on the seat. Also because of the tapering diameter, core 126 can be pumped out and fully separated from outer body 122 by backflow pressure against forward end 126*b*.

In one embodiment, outer annular body 122 is non-spherical on its outer surface. For example, outer annular body may have an outer wall shape that is circular in cross section orthogonal to its long axis xs, but may have a cylindrically shaped outer wall extending from a tapering surface at leading end 122*c*. This outer wall shape provides a longer shear plane S' than a spherical form of the same diameter would have. This means the ball 112 can have a higher pressure rating than a spherical form of the same external diameter.

In another embodiment, core 126 may be formed of a dissolvable material selected to break down with residence time in wellbore fluids. As such, even if core 126 is not pumped out by backflow pressure, core 126 in any event dissolves to open the flow path through sleeve 18.

In another embodiment, the ball is selected to land in a particular orientation on the seat so that the ball seating area can be configured to suitably land and seal against the sealing area of the seat, while the remainder of the ball body may not meet these requirements. For example, as described above, the ball may not have an outer spherical shape and so, it is intended to land with leading end 122*c* of the outer annular body 122 seated against seat 20. In one embodiment, therefore, the ball may include a nose extension 130 that ensures ball 112 properly seats in seat 20 with leading end 122*c* of the outer annular body 122 seated against seat 20. Nose extension 130 has a diameter smaller than the ball and smaller than seat 20, such that it fits down through the bore of sleeve 18. Nose extension 130 may be cylindrical or formed as a collet extending out from leading end 122*c* substantially parallel to long axis xs. There is an opening through nose extension that aligns with the bore of body 122 such that a fluid passage is formed fully through the actuation ball by the bore and the opening. While the fluid passage is normally closed by the core, the fluid passage can be opened by removal of the core by back flow pressure or degradation. For example, extension 130 may include inner walls 130*a* that substantially align with inner facing walls 122*a* of body 122. Nose extension 128 may carry one or more fins 132 that can capture fluid pressure to pull the ball along and ensure that nose extension 128 leads movement of the ball and prevents the ball from tumbling as it moves through the string. Fins 132 may be formed of a flexible material such as an elastomeric material such as rubber.

In FIGS. 3A to 3D, another embodiment of a wellbore actuation ball is shown. This ball includes a two-part outer annular body including an outer seat surface 222' and an inner cylinder 222". The leading end 222*c* of the outer seat surface 222' forms an annular seating surface for the ball. Core 226 is releasably installed and mechanically connected through a releasable connection such as a snap ring in a frustoconical inner diameter ID of inner cylinder 222".

The frustoconical inner diameter of inner cylinder 222" operates with core 226, which is wedge-shaped and not rigidly connected to the frustoconical inner diameter, to generate a wedge action when pressure is applied against piston face, rear end 226*a* of the core wherein core 226 causes the outer body 222" and 222' to expand for greater bearing area and load against a valve seat on which it is to be landed. Core 226 has a piston face end 226*a* exposed on the trailing end of the actuation ball and piston face end 226*a* can be convexly shaped to protrude outwardly relative to the surrounding surface of the two-part outer body.

Core 226 blocks fluid flow through the inner diameter ID until it is removed, as by popping out due to back pressure or by disintegration. There is a mechanical connection 223 between the core 226 and the two-part outer body 222', 222", the mechanical connection offers a releasable connection that is configured to permit complete detachment of the core from the outer body. The mechanical connection is configured to hold the core in the body for actuation of the downhole tool and to permit separation of the core from the outer body after actuation of the downhole tool. In particular, the actuation ball has a leading end and a trailing end and the core has a forward end 226*b* exposed on the outer surface of the leading end and the mechanical connection is configured to hold the core in the outer body against dislodgement through the leading end while permitting separation of the core from the outer body by movement of the core out from the trailing end. Mechanical connection 223 is configured to permit separation of the core from the outer body in response to a force applied against the forward end that is greater than a second force applied against the piston face end, in other words when a pressure differential is established across the core that generates a force toward the trailing end. In this embodiment, mechanical connection 223 is a snap connection such that core 226 snaps out upon flow back.

A seal 228 is positioned between core 226 and inner cylinder 222" to ensure that the interface between those parts has a fluid tight seal to hold pressure. Another seal 228*a* is installed between inner cylinder 222" and outer seat surface 222', also to ensure that pressure can be held across the trailing end of the actuation ball.

Figure 3A:
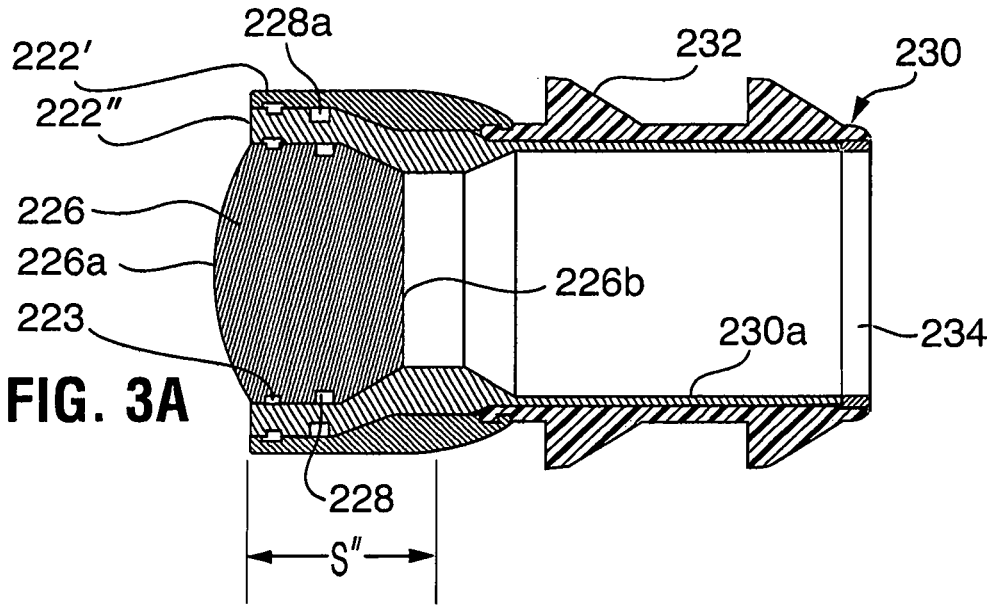
FIG. 3A is a sectional view along a center axis of an actuation ball according to another aspect of the invention.
Figure 3B:
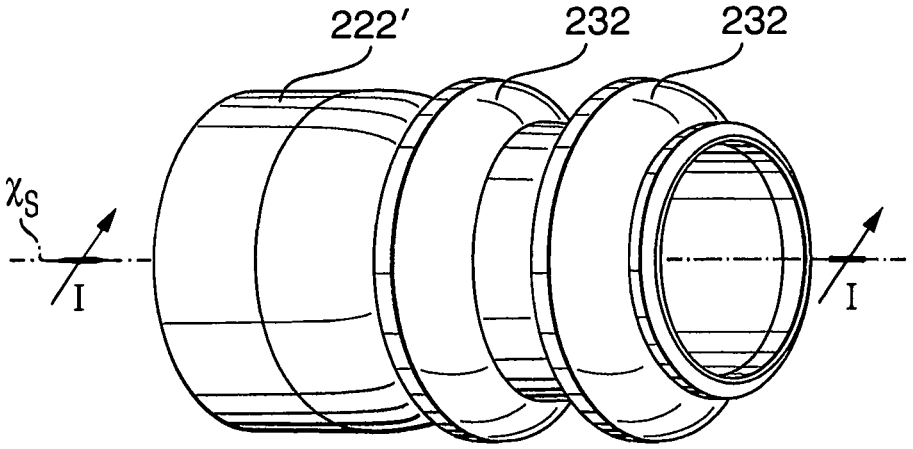
FIGS. 3B to 3D are respectively a perspective leading end view, a section along line I-I and a perspective trailing end view of the actuation ball, of FIG. 3A.
Figure 3C:
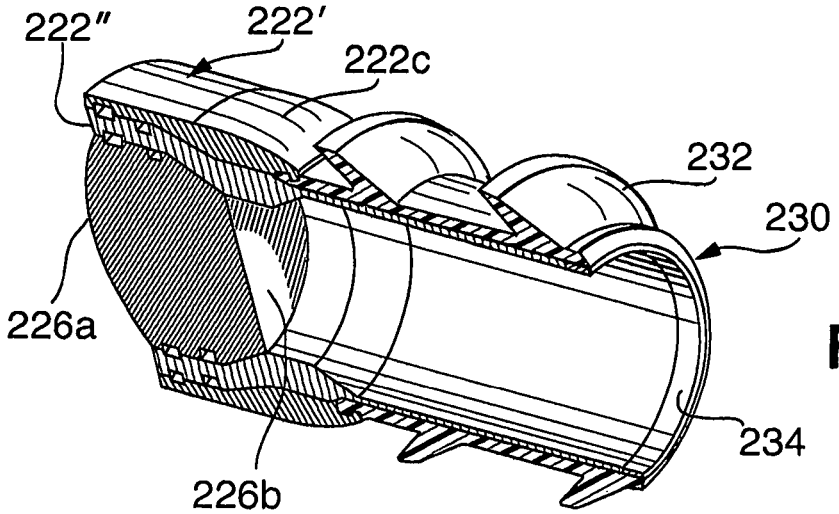
Figure 3D:
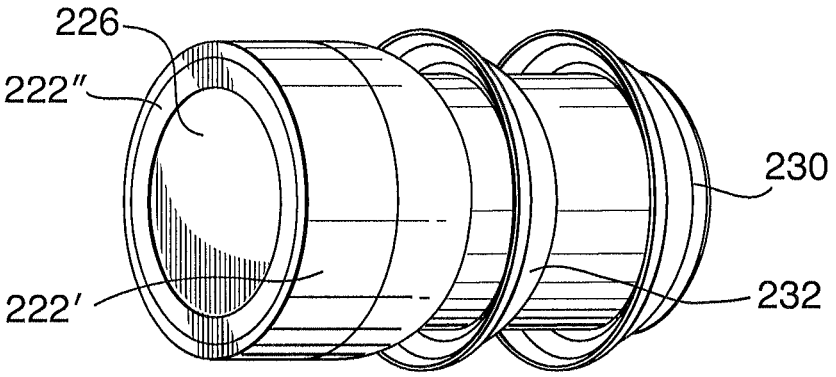

The actuation ball may further include a nose extension 230 extending from a leading end of the outer body. The nose extension may be a separate part connected to the outer body or may be integral. In the illustration of FIG. 3A, the nose extension is formed integral with inner cylinder 222" but includes an outer sheath with elastomeric fins 232.

The leading end 222*c* of the outer body encircles nose extension 230. The nose extension extends from the outer body substantially coaxially relative to a seating surface on the leading end and, thereby, the nose extension is configured to orient the seating surface to land in a valve seat of a downhole tool while the nose extension passes through the valve seat. The nose extension includes an axial opening 230*a* aligned with the inner diameter through the outer body such that the bore and the axial opening form a fluid passage through the actuation ball.

The materials used to form the outer body, including outer seat surface 222', inner cylinder 222" and core 226 can be selected for various characteristics. Because the actuation ball is formed of interconnected components, material selections may be made for the parts based on the desired function of each and well conditions.

For example, core 226 may be formed of a material selected to dissolve quickly in wellbore conditions, while the outer body is more durable and in whole or in part disintegrates over time. For example, inner cylinder 222" may be formed of a material more readily dissolved than outer seat surface 222'. Outer seat surface 222' may be formed of various materials such as aluminum, other metals, phenolic, some of which may be degradable. The outer seat surface may be relatively thin and may be formed to lock into the valve seat, as by use of a collet. In such an embodiment, the outer seat surface may be hard and durable and not intended to degrade, but rather may be intended to be milled out.

Inner core 226 can be rapidly degradable such that the inner diameter can be opened quickly after fracing. For example, inner core may be formed of phenolic, PGA, bonded sand plug, dissolvable metal, etc. In some embodiments, core 226 may be degraded by explosives and may be energized to achieve this effect. Alternately or in addition, the core or core and outer body interface may be configured for acid release upon frac initiation.

In one embodiment, the release of core 226 from the outer body, such as during snap out, may trigger core disintegration, such as by release of an acid, an explosion or exposure of a port to a dissolvable filler.

The core, core/outer body interface or mechanical connection may be configured to release of tracers upon frac or flow back. For example, chambers of tracer may be positioned between the parts, such as core 226 and inner cylinder 222", that later separate to expose the chambers.

Fins 232 and nose extension 230 can be made out of dissolvable/disintegrating materials, as well. If this renders the nose extension fragile, an end ring 234 of more durable material may be installed, as by bonding.

Electronics or other mechanisms may be carried on the actuation ball. For example, the actuation ball may carry a scanner for RFID tags in the liner/casing/sleeves such that the ball may react to a certain RFID signal, number or count such as to activate landing/seal. The actuation ball may have incorporated sensors to activate on fracturing.

The current actuation ball may be easier to build and machine than spherical balls. It may be a lower cost. The construction offers component based inventory.

Figure 4:
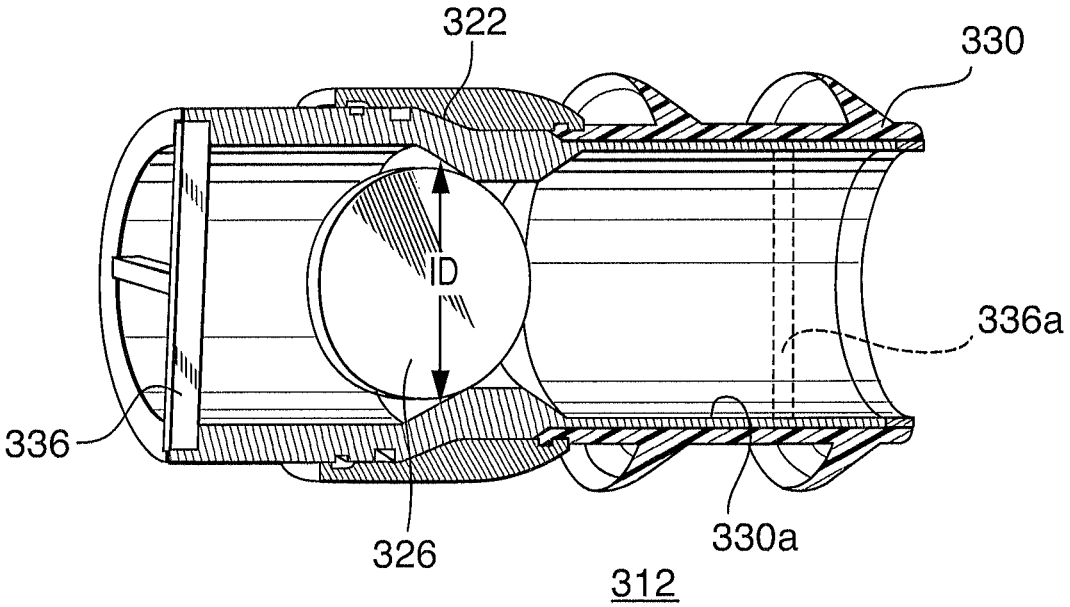
FIG. 4 is a sectional view along a center axis of an actuation ball according to another aspect of the invention.

Another embodiment of an actuation ball 312 is shown in FIG. 4. The actuation ball of FIG. 4 is similar to that of FIG. 3A in many ways except core 326 is a separable plug in the frustoconical inner diameter ID of outer body 322".

In this embodiment, core 326 is free of a physical lock to the outer body but is releasably connected in the frustoconical ID by fluid pressure during pumping down and actuation. When the actuation ball is exposed to back flow, core 326 can lift off the inner diameter of the outer body to allow fluid to flow up through the outer body.

In the illustrated embodiment, core 326 is actually formed as a spherical ball, but it may take other forms such as wedge-shaped, oblong, etc. A spherical ball is useful as it can seal against the frustoconical ID in any orientation.

A retaining baffle 336 may be installed across the inner diameter to keep the core with the outer body, even though the core is lifted off the frustoconical ID. This facilitates handling and prevents the ball from flowing back up and seating on the underside of a seat uphole. Alternately or in addition another retaining baffle 336*a* can be installed in the axial opening 330*a* through nose extension 330. Retaining baffle 336*a* also prevents a ball from below from flowing back up and seating on the underside of its frustoconical ID.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. An actuation ball for a downhole tool, the actuation ball comprising:

a core with frustoconical side walls, a piston face end and a forward end;

an outer body adapted to releasably hold the core, the outer body comprising a frustoconical bore through which fluid can flow if the core is removed, the bore having a tapered diameter adapted to releasably engage the frustoconical side walls of the core to stop the fluid flow through the bore, and an outer surface with a tapered portion adapted to seal against a valve seat of the downhole tool under pressure applied against the piston face end, and with a cylindrical portion extending uphole from the tapered portion; and a mechanical connection between the core and the outer body, the mechanical connection configured to permit separation of the core from the outer body in the uphole direction under pressure applied against the forward end.

2. The actuation ball of claim 1 wherein the mechanical connection is configured to hold the core in the outer body for actuation of the downhole tool and to permit separation of the core from the outer body after actuation of the downhole tool.

3. The actuation ball of claim 1 wherein the mechanical connection is configured to permit separation of the core from the outer body in response to a force applied against the forward end that is greater than a second force applied against the piston face end.

4. The actuation ball of claim 1 wherein the mechanical connection is a snap connection.

5. The actuation ball of claim 1 wherein the mechanical connection is a wedge lock connection.

6. The actuation ball of claim 1 wherein the frustoconical bore has a tapering inner diameter sized to substantially match; the side walls of the core to form a seal between the frustoconical side walls and the bore.

7. The actuation ball of claim 1, further comprising a nose extension extending from a leading end of the outer body.

8. The actuation ball of claim 7 wherein the leading end of the outer body includes an annular seating surface encircling the nose extension.

9. The actuating ball of claim 7 where the nose extension extends from the outer body substantially coaxially relative to a seating surface on the leading end, the nose extension configured to orient the seating surface to land in the valve seat of the downhole tool while the nose extension passes through the valve seat.

10. The actuation ball of claim 7 wherein the nose extension includes an axial opening aligned with the frustoconical bore such that the bore and the axial opening form a fluid passage through the actuation ball.

11. The actuation ball of claim 1 wherein the core is formed of material dissolvable in wellbore fluids.

12. A method for operating a downhole tool, the downhole tool including a tubular body; a sliding sleeve valve positioned within and axially moveable along a length of the tubular body, the sliding sleeve valve including a valve seat; and an inner bore defined by an inner wall of the tubular body and of the sliding sleeve valve, the method comprising:

moving an actuation ball to seal against the valve seat, the actuation ball comprising, a piston face end, a forward end, a tapered portion adapted to seal against the valve seat, a cylindrical portion extending uphole from the tapered portion, a frustoconical bore, and a core having frustoconical side walls, the core being releasably held in the frustoconical bore, such that the frustoconical side walls engage with the frustoconical bore;

applying pressure on the piston face of the core to drive the sliding sleeve valve to operate the downhole tool; and opening the frustoconical bore of the actuation ball to permit back flow by applying fluid pressure in an uphole direction on the forward end of the core opposite to the piston face to expel the core from the outer body.

13. The method of claim 12 further comprising dissolving the core by residence time in the well.

14. The method of claim 12 wherein moving the actuation ball includes applying fluid pressure against a fin on thea3 forward end of the actuation ball.

15. An actuation ball for a downhole tool, the actuation ball comprising:

an outer body including a trailing end, a leading end and a bore extending from the trailing end to the leading end; and a core in the bore having tapering side walls, a piston face end and a forward end, wherein the core is adapted for sealing against fluid flow through the bore by application of force on the piston face end, and wherein the core is adapted to be separated from the body by application of force on the forward end, the core being formed of a first degradable material and the outer body is made of a second material that degrades slower than the first degradable material such that the core disintegrates faster than the outer body.

16. The actuation ball of claim 15 wherein the bore has a tapering inner diameter that tapers from the piston end toward the forward end.

17. The actuation ball of claim 15 further comprising a fluid tight seal between the core and the bore.

18. The actuation ball of claim 15 further comprising a nose extension extending from the leading end of the outer body.

19. The actuation ball of claim 18 wherein the leading end of the outer body includes an annular seating surface encircling the nose extension.

20. The actuating ball of claim 18 where the nose extension extends from the outer body substantially coaxially relative to a seating surface on the leading end, the nose extension configured to orient the seating surface to land in a valve seat of a downhole tool while the nose extension passes through the valve seat.

21. The actuation ball of claim 18 wherein the nose extension includes an axial opening aligned with the bore.

22. The actuation ball of claim 15 wherein the outer body has an outer surface with a substantially cylindrical shape and a taper at a leading end forming a valve seating area.

* * * * *